US006138537A

United States Patent [19]

Cole

[11] Patent Number: 6,138,537

[45] Date of Patent: Oct. 31, 2000

[54] MULTI-TIP TOOL

[76] Inventor: Teresa M. Cole, 802 Fall Dr., Allen, Tex. 75002

[21] Appl. No.: 09/326,360

[22] Filed: Jun. 4, 1999

[51] Int. Cl.[7] ..... B25B 23/00

[52] U.S. Cl. ..... 81/439; 81/437

[58] Field of Search ..... 81/436, 437, 438, 81/439, 177.4, 440

[56] References Cited

U.S. PATENT DOCUMENTS

| | | | |
|---|---|---|---|
| 438,150 | 10/1890 | Glover . | |
| 532,823 | 1/1895 | Sanger . | |
| 1,000,900 | 8/1911 | Dorsey . | |
| 1,345,708 | 7/1920 | Schneider . | |
| 1,816,812 | 8/1931 | Allison . | |
| 2,566,543 | 9/1951 | Weglarz . | |
| 2,629,413 | 2/1953 | Stettler . | |
| 2,635,661 | 4/1953 | Egan . | |
| 2,679,770 | 6/1954 | Carter et al. . | |
| 2,714,409 | 8/1955 | Primrose et al. . | |
| 2,730,145 | 1/1956 | Brown . | |
| 2,749,953 | 6/1956 | Rundle . | |
| 2,765,013 | 10/1956 | Pedersen . | |
| 3,006,395 | 10/1961 | Dye . | |
| 3,683,984 | 8/1972 | Hull . | |
| 4,010,663 | 3/1977 | Rydberg . | |
| 4,227,430 | 10/1980 | Jansson et al. . | |
| 4,241,773 | 12/1980 | Personnat . | |
| 4,273,173 | 6/1981 | Smith et al. . | |
| 4,328,721 | 5/1982 | Massari . | |
| 4,372,362 | 2/1983 | Ahn . | |
| 4,480,668 | 11/1984 | Lin . | |
| 4,572,038 | 2/1986 | Graham . | |
| 4,653,356 | 3/1987 | Golden | 81/57.14 |
| 4,893,529 | 1/1990 | Lin | 81/177.1 |
| 4,945,790 | 8/1990 | Golden | 81/57.14 |
| 4,976,175 | 12/1990 | Hung | 81/439 |

*Primary Examiner*—Timothy V. Eley
*Assistant Examiner*—Dung Van Nguyen
*Attorney, Agent, or Firm*—Richard J. Veltman

[57] ABSTRACT

A multi-tip tool includes a push button assembly, a cylinder assembly having a plurality of chambers for receiving working tips, and a drive shaft. The drive shaft is coupled to the cylinder assembly for longitudinal movement through a chamber and transverse movement relative to the cylinder. The drive shaft is movable transversely between an engaged position and a disengaged position and longitudinally between the engaged position and a replacement position. The cylinder assembly includes a central conduit, the plurality of chambers being arranged circumferentially around the central conduit, and a plurality of passages connecting the plurality of chambers with the central conduit. The drive shaft is movable through one of the plurality of passages between the engaged position and the replacement position. The multi-tip tool further includes a push button assembly coupled to the cylinder assembly.

29 Claims, 11 Drawing Sheets

MULTI-TIP TOOL

The present invention relates to hand tools. In particular, the invention relates to tools having a plurality of interchangeable working tips. More particularly, the invention relates to tools wherein the operating tips are stored internally and can be selectively aligned with an operating axis for engagement with a drive shaft. The invention also relates to tools wherein any of the working tips can be replaced without disassembling the tool.

BACKGROUND OF THE INVENTION

At various times, workmen use different types of hand tools such as screwdrivers, chisels, awls, and the like. These types of implements have become standard instruments in performing specific work tasks such as driving screws into a work piece or chiseling away undesirable material. There are occasions, however, in which a workman uses a number of different tools to complete a task. For example, the workman may need to alternately use a straight edge screwdriver and a Philips screwdriver. In order to address such situations, a number of multi-purpose tools have been developed. Multi-purpose tools not only provide versatility and time savings, but usually save on tool storage space.

Many types of multi-purpose tools have been developed. There are tools in which a plurality of working tips are freely stored within a handle. For example, U.S. Pat. No. 3,683,984 to Hull and U.S. Pat. No. 4,227,430 to Jansson disclose storing replaceable bits in longitudinal grooves formed in the outside of a handle. With these tools the desired tip is selected and taken from its storage compartment and manually placed in its working position. In most cases, the working tip must be secured in its working position by a spring-loaded detent, locking screw, chuck, or magnet To exchange the working tip being used for another working tip, the securing means must be disengaged before the working tip being used may be removed. Once it is removed, a new working tip may be positioned and secured in the working position. If the workman must change between various working tips, he must repeat the procedure of engaging the securing means, removing the working tip, replacing the working tip with another working tip, and then re-engaging the securing means. When a magnet is used as the securing means, it is possible for the tip to bind on the work piece and pull out of the tool as the tool is withdrawn.

Other types of multi-function tools have avoided time-consuming and frustrating problems created by having a plurality of working tips which must be attached or detached to the tool. Such tools typically position and secure the working tip in its operating position by some mechanical means which is manually operated without manually removing and handling the working tip. Examples include tools disclosed in U.S. Pat. No. 438,150 to Glover and in U.S. Pat. No. 1,816,812 to Allison. Glover and Allison position the working tip over a stationary chute which directs the working tip into its operative position. When the working tip is aligned with the chute, the tip is released and drops into its operating position and is appropriately secured. Unfortunately, these designs still require manipulation of a set screw or chuck to lock the working tip in position.

U.S. Pat. No. 4,572,038 to Graham discloses is a tool having a cylinder assembly containing a plurality of tips. As the cylinder is rotated, each of the tips is aligned with a stationary chute. A drive shaft, coupled to a handle, engages the tip and pushes the tip through the chute to an operative position. Unfortunately, Graham's working tips cannot be replaced without destroying the tool. Thus, the tools usefulness diminishes as tips break. Moreover, unless a particular tool has all of the different types and sizes of working tips that a user needs, the user needs more than one tool.

SUMMARY OF THE INVENTION

The present invention overcomes these disadvantages and others by providing a multi-tip toot having a push button assembly, a cylinder assembly having a plurality of chambers for receiving working tips, and a drive shaft coupled to the cylinder assembly for longitudinal through the chamber and transverse movement relative to be cylinder. The drive shaft is movable transeversely between an engaged position and a disengaged position and longitudinally between the engaged position and a replacement position.

The cylinder assembly includes a central conduit, the plurality of chambers being arranged circumferentially around the central conduit, and a plurality of passages connecting the plurality of chambers with the central conduit. The drive shaft is movable through one of the plurality of passages between the engaged position and the replacement position.

The multi-tip tool further includes a push button assembly coupled to the cylinder assembly. The push button assembly includes a follower that engages the drive shaft. The follower co-operates with a plurality of grooves formed in the drive shaft to allow the drive shaft to move between a disengaged position, an immediate position, an engaged position, and a replacement position. The follower and grooves co-operate to prevent rotational movement of the drive shaft at the engaged position and at the replacement position and to allow rotational movement of the drive shaft at the intermediate working position.

DETAILED DESCRIPTION OF THE DRAWINGS

Figure 1:
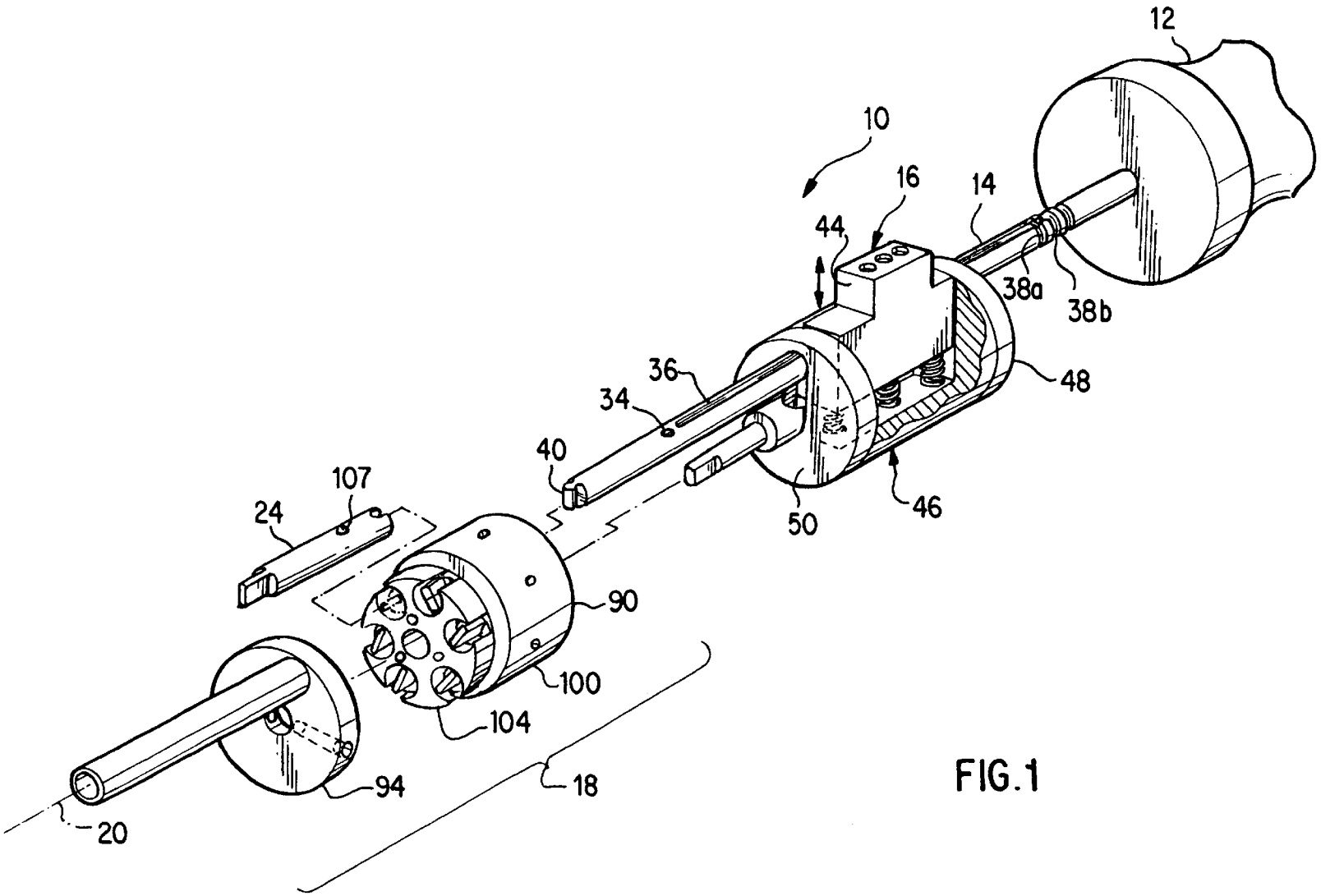
FIG. 1 is a perspective view of a multi-tip tool according to the present invention
Figure 13:
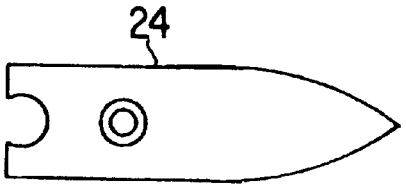
FIG. 13 illustrates a awl working tip for use with the tool of FIG. 1.

A multi-tip tool 10 constructed according to the present invention is illustrated in FIG. 1. The tool 10 includes a handle 12, a drive shaft 14, a push button assembly 16 and a cylinder assembly 18. As will be described later with respect to FIGS. 14–16, the drive shaft 14 is adapted to pass longitudinally through the push button assembly 16 and the cylinder assembly 18 along an operating axis 20 and to move transversly from the operating axis 20 between an engaged position and a disengaged position. The cylinder assembly 18 includes a plurality of working tips 24 that are aligned with the longitudinal axis of the drive shaft 14. The drive shaft 14 is configured to engage a working tip 24 and push it through the cylinder assembly 18 to an operative position (FIG. 13).

Figure 2A:
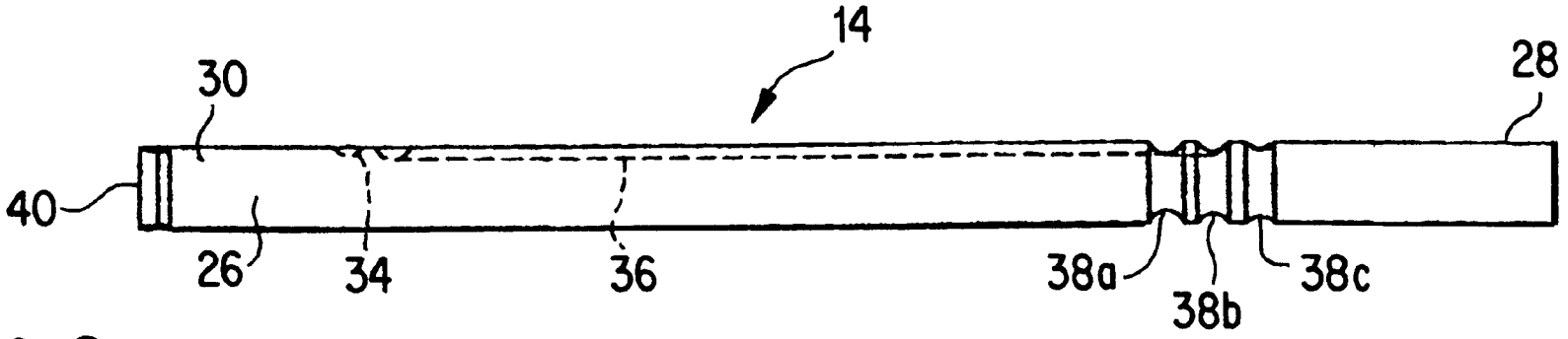
FIGS. 2*a*–2*b* are orthogonal views of a drive shaft.
Figure 2B:
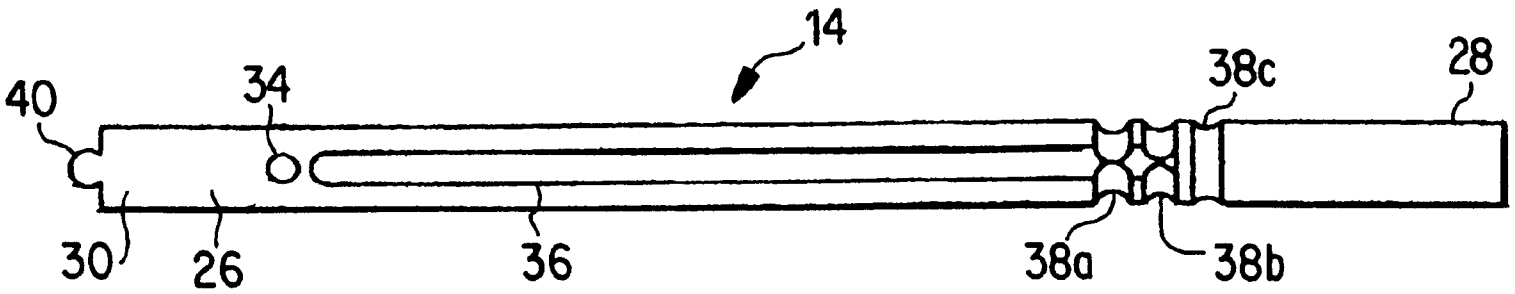

The drive shaft 14, as illustrated in FIG. 2, includes a generally cylindrical body 26 having a proximal end 28 and a distal end 30, a circular recess 34 near the distal end 30, a longitudinally extending groove 36 extending from adjacent the circular recess 34 toward the proximal end 28, and three circumferential grooves 38*a*–38*c* near the proximal end 28. The longitudinal groove 36 intersects two of the circumferential grooves 38*a*, 38*b*. The grooves 36, 38 are configured to receive a follower, typically a detent ball. As will be described later, the follower locks the drive shaft 14 against rotational movement when disposed in the longitudinal groove 36, while permitting rotational movement when disposed in one of the circumferential grooves 38. The distal end 30 of the drive shaft 14 includes a transverse cylindrical tenon 40. The engagement tip is oriented on the distal end 30 of the drive shaft 14 so that the longitudinal axis of the tenon 40 intersects the longitudinal axis of the detent groove 36.

Figure 3A:
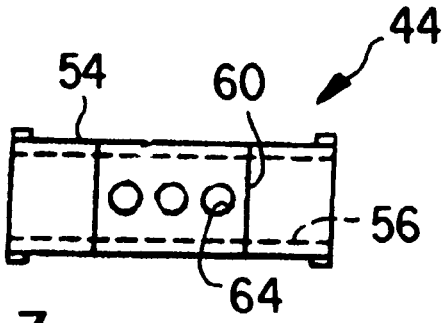
FIGS. 3*a*–3*c* are orthogonal views of a push button.
Figure 3B:
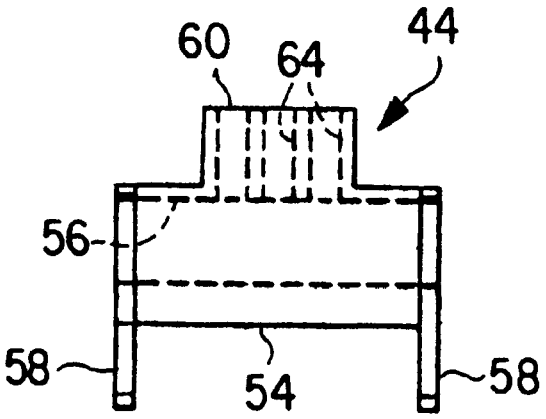
Figure 3C:
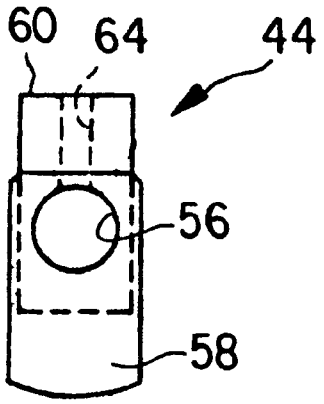
Figure 4A:
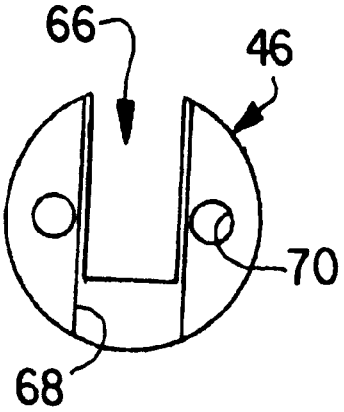
FIGS. 4*a*–4*b* are orthogonal views of a push button receiver.
Figure 4B:
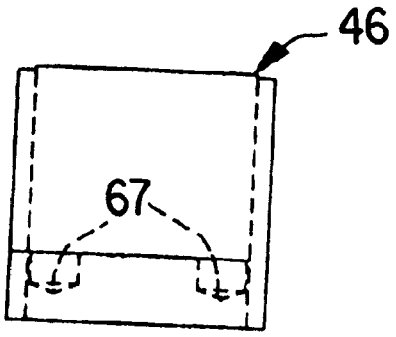
Figure 6A:
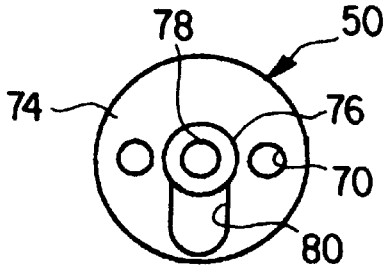
FIGS. 6*a*–6*d* are orthogonal views of a push button assembly spindle plate.
Figure 6B:
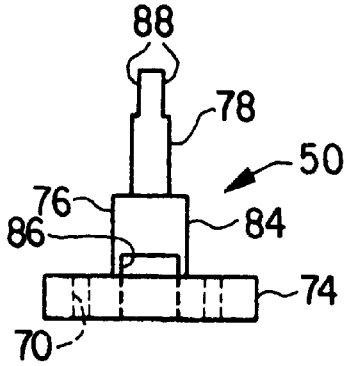
Figure 6C:
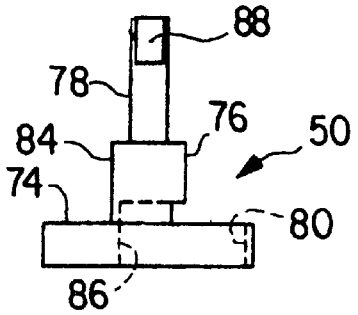
Figure 6D:
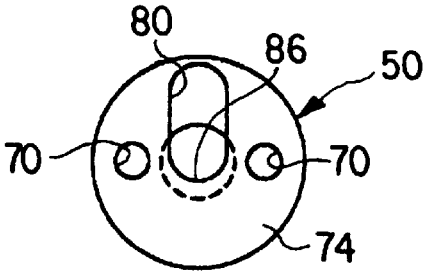
Figure 5:
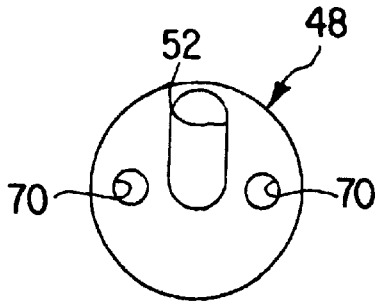
FIG. 5 illustrates a push button assembly end plate.
Figure 7C:
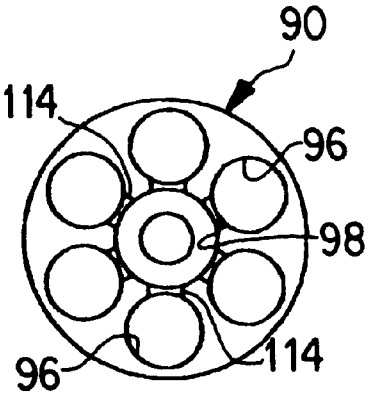
FIGS. 7*a*–7*c* are orthogonal views of a tip storage cylinder.
Figure 7B:
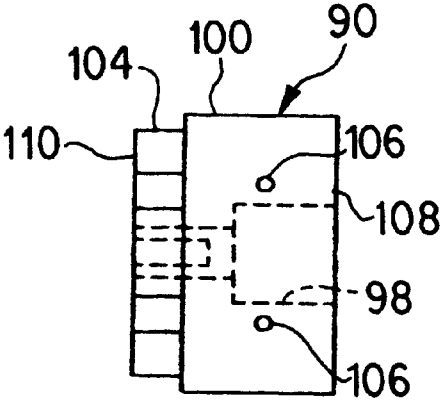
Figure 7A:
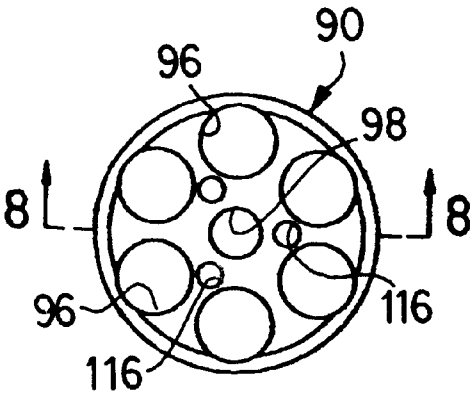
Figure 8:
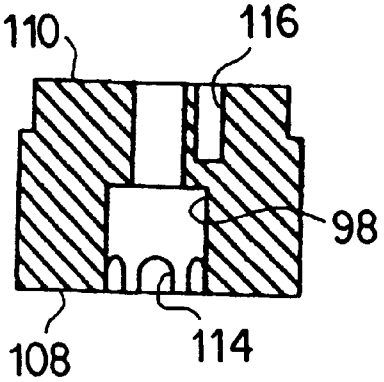
FIG. 8 is a section view taken along lines 8—8 of FIG. 7*a*.
Figure 14:
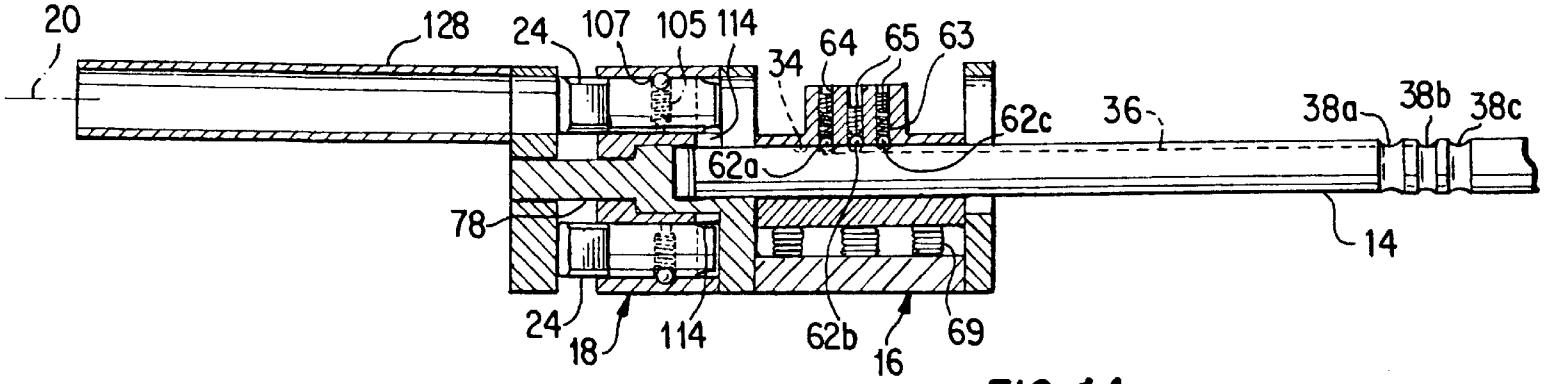
FIG. 14 is a longitudinal section view taken through the multi-tip tool of FIG. 1 illustrating the drive shaft in a standby position prior to engagement with the working tip.
Figure 15:
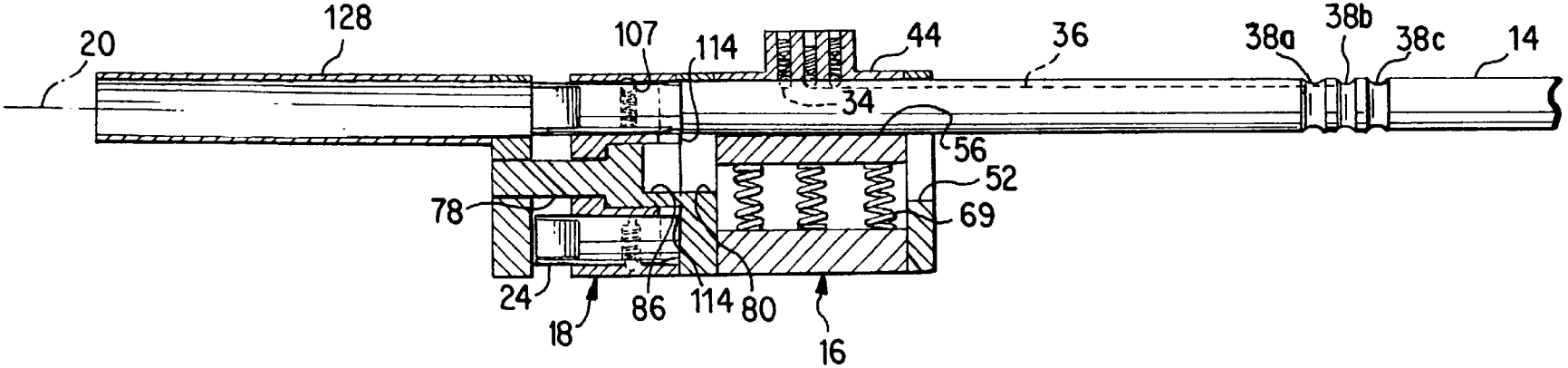
FIG. 15 is a section view similar to FIG. 14 illustrating the drive shaft engaged with the working tip at an engaged position.
Figure 16:
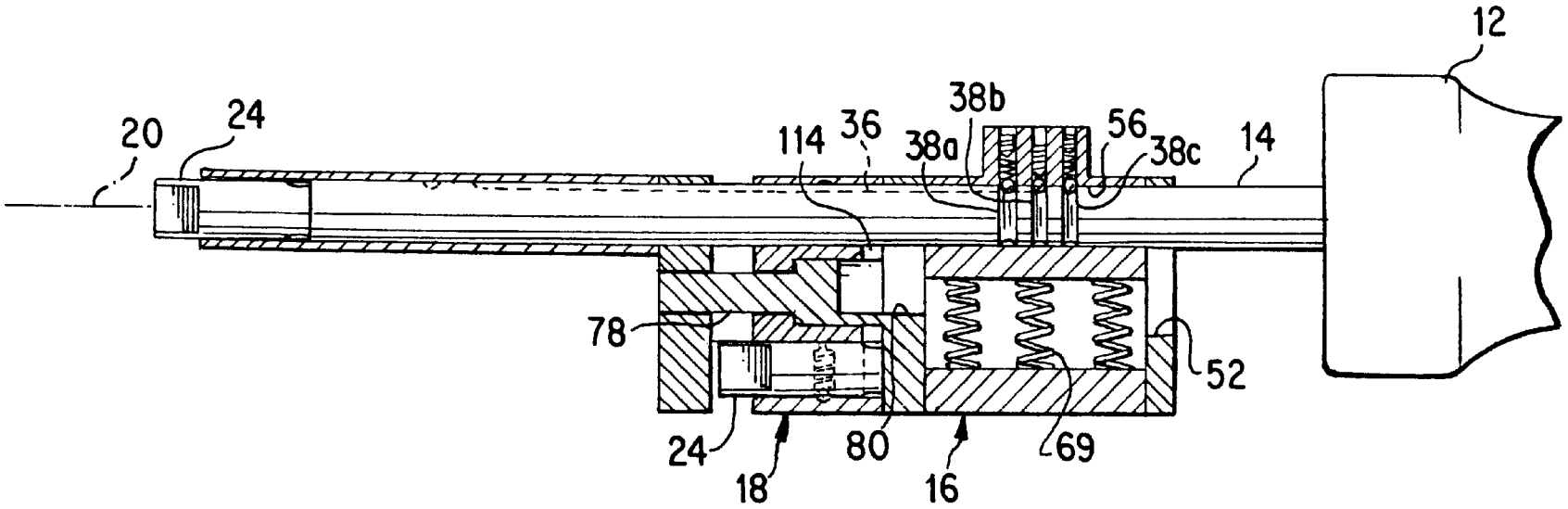
FIG. 16 is a section view similar to FIG. 14 illustrating the working tip at the operative position.

The push button assembly 16 includes a push button 44, a generally cylindrical receiver 46, a circular end plate 48, and the circular spindle plate 50. The push button 44, illustrated in FIGS. 3*a*–3*c*, includes a generally rectangular body portion 54 having a circular, longitudinally extending first drive shaft-receiving bore 56, a pair of skirts 58 depending downwardly from opposite ends of the body portion 54, and a button portion 60 extending upwardly from the center of the body portion 54. The button portion 60 includes a plurality of detent ball-receiving bores 64 extending upwardly from the first drive shaft-receiving bore 56. In one embodiment of the invention, the detent ball-receiving bores 64 extend through the button portion 60 and are threaded to receive a set screw 65 (FIGS. 14–16) for retaining a detent ball 62 and a spring 63 in each receiving bore 64. Alternatively, the ball-receiving bores 64 can be smooth and extend through the body portion 54 and partially into the button portion 60, a spring and detent ball 62 being inserted into the detent ball-receiving bores 64 through the body portion 54. The generally cylindrical receiver 46, illustrated in FIGS. 4*a*–4*b*, includes a longitudinal rectangular channel 66 configured to receive the rectangular body portion 54 of the push button 44, a pair of vertical guide channels 68 configured to receive the skirts 58, and a pair of longitudinally extending retainer-receiving bores 70. Preferably, the rectangular channel 66 includes a pair of recesses 67 extending downwardly from the channel 66 for receiving springs 69 (FIGS. 14–16). The circular end plate 48, illustrated in FIG. 5, includes a pair of retainer-receiving bores 70 and a first oval drive shaft-receiving bore 52.

The cylindrical spindle plate 50, illustrated in FIGS. 6*a*–6*d*, includes a plate portion 74, a drive shaft-receiver portion 76 extending from one side of the plate portion 74, and a spindle 78 extending from the drive shaft-receiver portion 76. The plate portion 74 includes a pair of retainer-receiving bores 70 and a second oval drive shaft-receiving bore 80. When the cylindrical receiver 46, the end plate 48 and the spindle plate 50 are assembled, their respective retainer-receiving bores 70 are aligned to receive screws or retaining pins or the like to hold the cylinder and push button assemblies together, and the first and second oval drive shaft-receiving bores 52, 80 are aligned with the rectangular channel 66 of the receiver 46. The drive shaft-receiver portion 76 of the spindle plate 50 is aligned with the longitudinal axis of the push button assembly 16 and extends from the plate portion 74. The drive shaft-receiver portion 76 includes a generally cylindrical body 84 having a longitudinal U-shaped channel 86 extending partially therethrough. The U-shaped channel 86 is sized and configured to match the contour of the oval drive shaft-receiving bores 52, 80. The spindle 78 is generally cylindrical and is aligned with longitudinal axis of the push button assembly 16. The distal end of the spindle 78 includes a pair of parallel flats 88.

The cylinder assembly 18 includes a tip storage cylinder 90 and a retainer plate 94. The tip storage cylinder 90, illustrated in FIGS. 7*a*–7*c* and 8, includes a plurality of tip-receiving chambers 96 arranged circumferentially around a central conduit 98. The central conduit 98 is configured to receive the spindle 78 and the drive shaft-receiver portion 76 of the push button assembly 16, thereby permitting the cylinder 90 to rotate about the spindle 78 relative to be retainer plate 94 and the push button assembly 16. As best illustrated and FIG. 1, the cylinder 90 includes a base portion 100 and a stepped portion 104 having a reduced outside diameter such that working tips 24 stored in the plurality of chambers 96 are exposed to view at the stepped portion 104 of the cylinder 90. The side wall of the base portion 100 includes a plurality of detent ball-receiving bores 106. Each of the detent ball-receiving bores 106 extends into one of the plurality of chambers 96. Detent balls 107 (FIG. 1) coupled to the working tips 24 engage the detent ball-receiving bores 106 to retain and align the working tips 24 in the tip-receiving chambers 96.

The cylinder 90 further includes a first end surface 108 and a second end surface 110. The first end surface 108 of the cylinder 90 includes a plurality of connecting passages 114 that extend between the plurality of chambers 96 and the central conduit 98. The connecting passages 114 are sized and configured to receive the transverse cylindrical tenon 40 formed on the distal end 30 of the drive shaft 14. The second end surface 110 of the cylinder 90 includes a plurality of detent ball-receiving bores 116. The bores 116 are disposed between the central conduit 98 and the plurality of chambers 96 and are configured to receive a spring and detent ball (not shown).

Figure 9C:
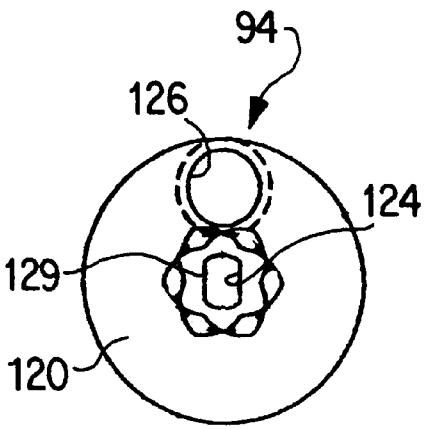
FIGS. 9*a*–9*c* are orthogonal views of a cylinder assembly retaining plate.
Figure 9B:
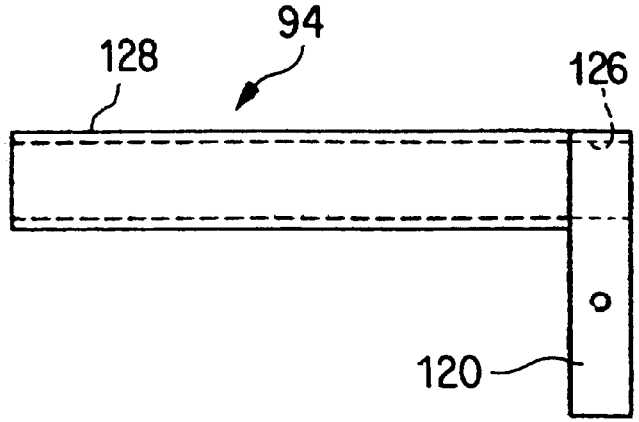
Figure 9A:
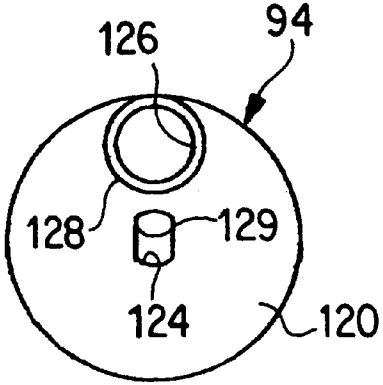

The retainer plate 94, illustrated in FIGS. 9*a*–9*c* includes a disk 120 having a central aperture 124, a drive shaft-receiving aperture 126, and a barrel 128 extending from the disk 120 at the drive shaft-receiving aperture 126. The central aperture 124 includes a pair of flat surfaces 129 configured to engage the parallel flats 88 formed on the spindle 78. Thus, when the push button assembly 16 and cylinder assembly 18 are assembled, the drive shaft-receiving bores 52, 80 of the push button assembly 16 are aligned with one of the working tip-receiving chambers 96 and with the drive shaft receiving aperture 126 and barrel 128. A first surface of the disk 120 includes a plurality of detent ball-receiving recesses 130. The detent ball-receiving recesses 130 are positioned to align with the detent ball-receiving bores 116 on the tip storage cylinder 90 to provide a detent position for each chamber 96 along the operating axis 20.

Figure 11:
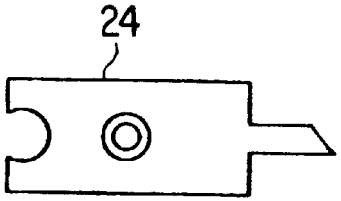
FIG. 11 illustrates a chisel working tip for use with the tool of FIG. 1.
Figure 12:
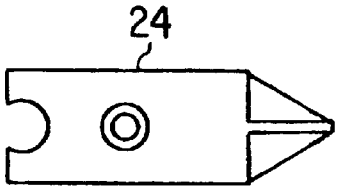
FIG. 12 illustrates a phillips head screwdriver working tip for use with the tool of FIG. 1.
Figure 10A:
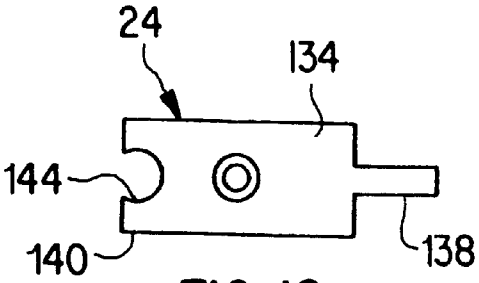
FIGS. 10*a*–10*c* are orthogonal views of a flat edge screwdriver working tip for use with the tool of the FIG. 1.
Figure 10B:
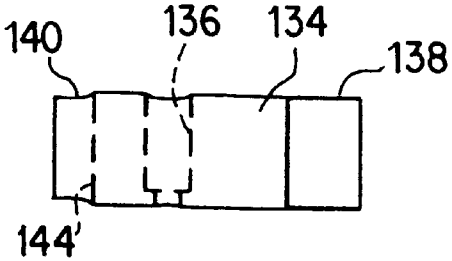
Figure 10C:
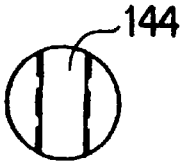

FIGS. 10*a*–10*c* illustrate atypical working tip 24. The working tip 24 includes a generally cylindrical body 134, a transverse bore 136 extending through the body 134, a working end 138, and an engagement end 140. The working end 138 can include any of the customary tools used by a workman, such as a flat blade screwdriver as illustrated in FIG. 10*a*, or a chisel, Philips head screwdriver, or awl, illustrated in FIGS. 11–13, respectively, or the like. The engagement end 140 includes a generally cylindrical mortice 144 aligned parallel to the transverse bore 136. The mortice 144 is sized to receive the cylindrical tenon 40 formed on the distal end 30 of the drive shaft 14. In addition, the mortice 144 is positioned so that the greatest diameter is offset from the end surface of the engagement end 140, thereby providing a positive engagement between the working tip 24 and the drive shaft 14. The positive engagement ensures that the working tip 24 will not separate from the drive shaft 14 while at the operative position, regardless of the orientation of the multi-tip tool 10.

The transverse bore 136 is configured to receive a spring 105 and detent ball 107 for engaging one of the detent ball-receiving bores 106 formed in the side wall of the tip storage cylinder 90. When the detent ball 107 engages the detent ball-receiving bore 106, the working tip 24 is positioned in the chamber 96 with the mortice 144 coaxially aligned with the passage 114 connecting the chamber 96 with the central conduit 98. When the mortice 144 is aligned with the passage 114, the tenon 40 can move transversely through the passage 114 between an engaged position and a disengaged position.

FIGS. 14–16 illustrate movement of drive shaft 14 from a standby position (FIG. 14) to an engaged position (FIG. 15) to the operative position (FIG. 16). As illustrated, the drive shaft 14 extends through the first and second oval drive shaft-receiving bores 52, 80 and the drive shaft-receiving bore 56 of the push button 44. The drive shaft-receiving bores 52, 56, 80 co-operate to align the drive shaft 14 parallel to the longitudinal axis of the tool 10. In a standby position, illustrated in FIG. 14, the distal end 30 of the drive shaft 14 is disengaged from the working tip 24 and extends into the central conduit 98. The tip storage cylinder 90 is free to rotate about the spindle 78 allowing a user to select a desired working tip 24. Located in the U-shaped channel 86 in the standby position, the drive shaft 14 is prevented from moving to the left, as viewed in FIG. 14, but is free to move to the right within the limitations imposed by the three detent balls 62*a*–62*c* in the push button 44. The right and left detent balls 62*a*, 62*b*, as viewed in FIGS. 14–16, are urged into engagement with the longitudinal groove 36 by springs 63 disposed in the detent ball-receiving bores 64. The center detent ball 62*b* is fixed in positioned by a set screw 65. As the drive shaft 14 is pulled to the right from the standby position, the left detent ball 62*a* rides up and out of the longitudinal groove 36 against the force of the spring and engages the circular recess 34. The center detent ball 62*b* moves to the end of the longitudinal groove 36 and, being fixed in position, cannot ride up and out of the longitudinal groove 36 and thereby prevents further drive shaft movement to the right. When the left detent ball 62*a* is engaged with the circular recess 34 and the center and right detent balls 62*b*, 62*c* are engaged with the longitudinal groove 36, the drive shaft 14 is at a disengaged position wherein the tenon 40 is aligned with the passage 114 and the mortice 144 of the working tip 24. Springs 69 disposed between the push button 44 and receiver 46 urge the drive shaft 14 upwardly into the chamber 96 to the engaged position (FIG. 15) wherein the tenon 40 is engaged with the mortice 144 of the working tip 24.

As illustrated in FIG. 15, the drive shaft 14 engages the working tip 24 and is free to move through the chamber 96 and barrel 128 along the operating axis 20. As the drive shaft 14 moves to the left, the left detent ball 62*a* rides up and out of the circular recess 34 and re-engages the longitudinal groove 36. As the drive shaft 14 continues to the left, the three detent balls 62*a*–62*c* align with the three circumferential grooves 38*a*–38*c*. Since the longitudinal groove 36 extends through the left and center circumferential groove 38*a*, 38*b*, the right detent ball 62*c* rides up and out of the longitudinal groove 36 against the force of this spring and engages the right circumferential groove 38*c*. With the three detent balls 38*a*–38*c* thus aligned with the three circumferential grooves 38*a*–38*c*, as illustrated in FIG. 16, the drive shaft 14 is free to rotate relative to the cylinder assembly 18 and push button assembly 16. Moreover, since there is no connection between the center and right circumferential grooves 38*b*,38*c*, the fixed center detent ball 62*b* and the right detent ball 62*c* co-operate to retain the working tip 24 at the operative position.

To change working tips 24, a user moves to drive shaft 14 to the right along the operating axis 20 to the engaged position, where the tenon 40 formed on the tip of the drive shaft 14 is aligned with the passage 114 in the cylinder 90. The user moves the push button 44 down to move the drive shaft 14 from the operating axis 20 to the disengaged position and then moves to drive shaft 14 to the left to the standby position illustrated FIG. 14. With the drive shaft 14 in the standby position, the tip storage cylinder 90 is free rotate about the spindle 78, allowing a user to align the desired working tip 24 with the operating axis 20. Once the desired working tip 24 is aligned with the working axis, the drive shaft 14 is moved to the right to the disengaged position, where the force of the push button springs 69 moves the drive shaft 14 transversely to the engaged position. Moving drive shaft 14 to the left along the operating axis 20 moves the new working tip 24 to the operative position.

Figure 18:
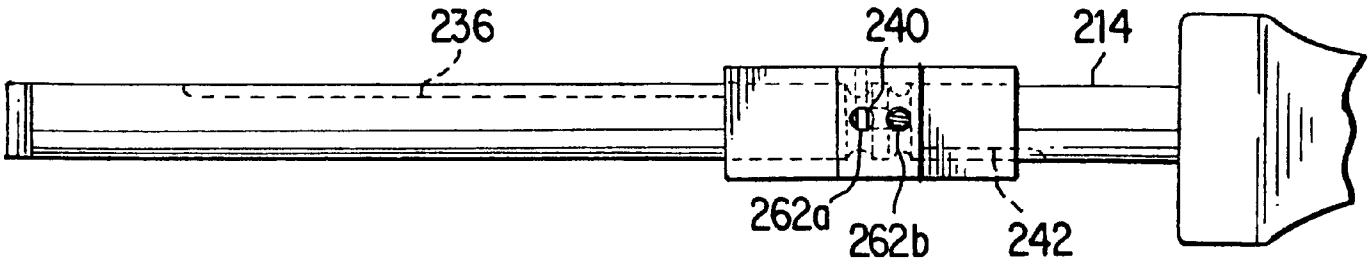
FIG. 18 is a top view of the drive shaft of FIG. 17 with detent balls in the push button aligned with a crossover groove in the drive shaft.
Figure 19:
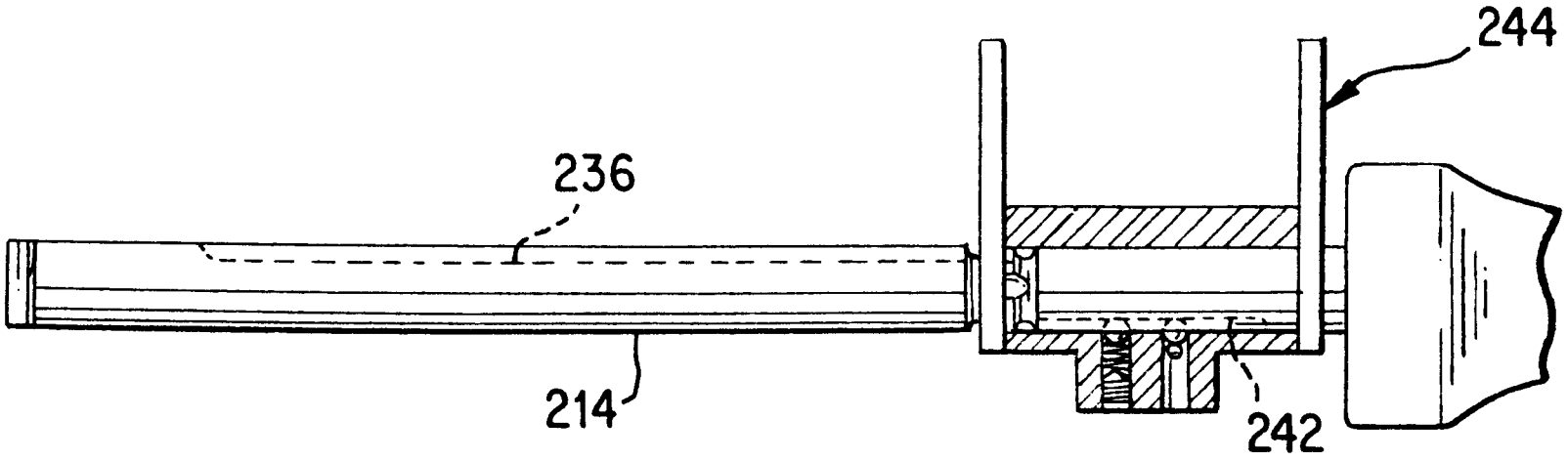
FIG. 19 illustrates the detent balls of the push button engaged with the second longitudinal groove on the drive shaft of FIG. 17.

The above-described multi-tip tool 10 can be modified to allow removal or replacement of the working tip 24 without disassembling the tool 10. One such modification can include a crossover groove 240 connecting a pair of circumferential grooves 238*a*, 238*b* and a second longitudinal groove 242 offset circumferentially from the first longitudinal groove 240, as illustrated in FIGS. 17–19.

Replacing the working tip 24 without disassembling the tool 10 includes the steps of moving the working tip 24 and drive shaft 214 along the axis 20 to a first position, rotating the tip 24 and drive shaft 214 about the axis 20 to a second position, and moving the working tip 24 and drive shaft 214 from the second position along the axis 20 to a replacement position.

The step of moving the working tip 24 and drive shaft 214 to a replacement position includes the steps of rotating the tip 24 and drive shaft 214 about the axis 20 to a third position, and moving the working tip 24 and drive shaft 214 along the axis 20 from the third position to the replacement position.

Figure 17:
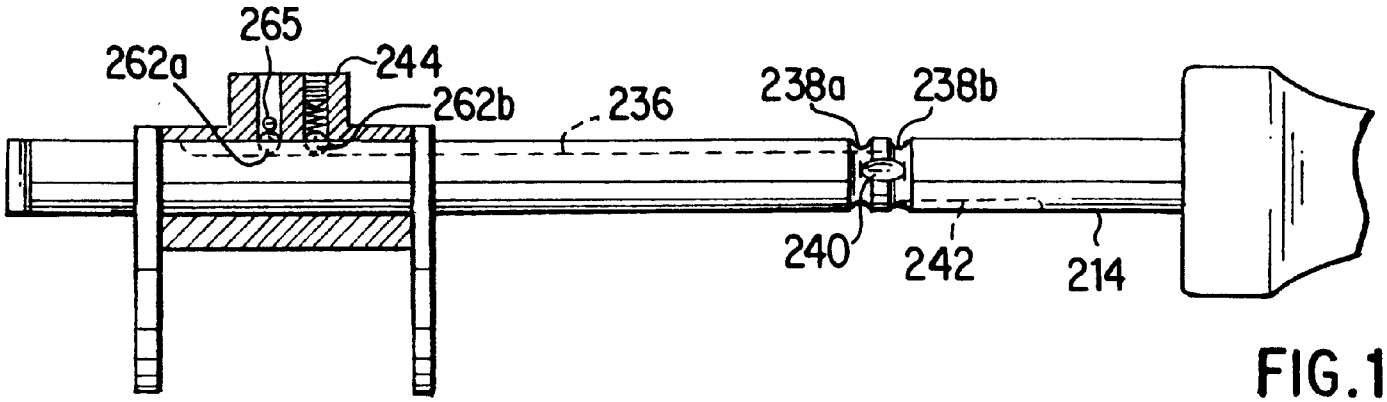
FIG. 17 is a side view of an alternative embodiment of the drive shaft configured to allow replacement of a working tip without disassembling the tool.

FIG. 17 illustrates a push button 244 having a pair of detent balls 262*a*, 262*b* engaged with a longitudinal groove 236 formed in the drive shaft 214. In the illustrated embodiment, the longitudinal groove 236 intersects the left circumferential groove 238*a*. The right detent ball 262*b*, as viewed in FIG. 17, is spring loaded, whereas the left detent ball 262*a* is fixed by a retaining pin. The spring loaded detent ball 262*b* can rise up and out of the left circumferential groove 238*a* and engage the right circumferential groove 238*b* while the fixed detent ball 262*a* remains in the left circumferential groove 238*a*. With the detent balls 262*a*, 262*b* aligned with the circumferential grooves 238*a*, 238*b* in this fashion, the working tip 24 is at the operative position the first position, and the drive shaft 214 is free to rotate.

The crossover groove 240, which is offset circumferentially from the longitudinal groove 236, connects the circumferential grooves 238*a*, 238*b* and allows the fixed detent ball 262*a* to enter the right circumferential groove 238*b*. In the illustrated embodiment, the drive shaft 214 is rotated 90 degrees to the second position to align the detent balls 262*a*, 262*b* with the crossover groove 240. The drive shaft 214 moves to the left, as viewed in FIGS. 17–19, to move the right detent ball 262*b* up and out of the right circumferential groove 238*b* and to move the fixed detent ball 262*a* into the right circumferential groove 238*b*. The drive shaft 214 is then rotated an additional 90 degrees to the third position to align the detent balls 262*a*, 262*b* with a second longitudinal groove 242. The drive shaft 214 is then moved an additional amount to the left, which moves the working tip 24 to a replacement position. At the replacement position, the distal end of the drive shaft 214 extends beyond the barrel 128 of the cylinder assembly 18, allowing the working tip 24 to be disengaged from the drive shaft 214. At this point, a user can engage a new working tip 24 with the drive shaft 214 and pull the drive shaft 214 to the right, withdrawing the mortice and tenon connection into the barrel 128. When the fixed detent ball 262*a* is positioned in the right circumferential groove 238*b*, the drive shaft 214 is rotated 90 degrees to align the fixed detent ball 262*a* with the crossover groove 242. Pulling the drive shaft 214 to the right moves the fixed detent ball 262*a* into the left circumferential groove 238*a* and drops the spring loaded detent ball 262*b* into the right circumferential groove 238*b*. Rotating drive shaft 214 an additional 90 degrees, to align the detent balls 262*a*, 262*b* with the first longitudinal groove 236, and pulling to the right moves the working tip 24 through the operative position to be engaged position.

While the invention has been described in detail in connection with preferred embodiments known at the time, it should be readily understood that the invention is not limited to such disclosed embodiments. Rather, the invention can be modified to incorporate any number of variations, alterations, substitutions or equivalent arrangements not heretofore described, but are commensurate with the spirit and scope of the invention.

What is claimed is:

1. A multi-tip tool comprising:

a cylinder assembly having a longitudinal axis and a plurality of chambers for receiving working tips;

a push button assembly coupled to the cylinder assembly; and a drive shaft coupled to the push button assembly for longitudinal and transverse movement relative to the cylinder.

2. The multi-tip tool of claim 1 wherein the drive shaft is movable transversely between an engaged position and a disengaged position and longitudinally between the engaged position and a replacement position.

3. The multi-tip tool of claim 2 wherein a working tip is disposed in one of the plurality of chambers when the drive shaft is at the engaged position and at the disengaged position.

4. The multi-tip tool of claim 2 wherein a working tip is disposed in one of the plurality of chambers when the drive shaft is at the engaged position and outside of the cylinder assembly when the drive shaft is at the replacement position.

5. The multi-tip tool of claim 1 wherein the cylinder assembly includes a central conduit, the plurality of chambers being arranged circumferentially around the central conduit, and a plurality of passages connecting the plurality of chambers with the central conduit.

6. The multi-tip tool of claim 5 wherein the drive shaft is movable through one of the plurality of passages between an engaged position and a disengaged position.

7. A multi-tip tool having an operating axis, the tool comprising:

a cylinder assembly;

a push button assembly coupled to the cylinder assembly; and a drive shaft coupled to the push button assembly and to one of a plurality of working tips, the shaft being configured for movement between a disengaged position, an engaged position, an operative position, and a replacement position, wherein the engaged position, the operative position, and the replacement position are located on the operating axis and the disengaged position is transversely offset from the operating axis.

8. The multi-tip tool of claim 7 further including a follower coupled to the drive shaft wherein the drive shaft further includes a longitudinal groove and a circumferential groove, the grooves being configured to co-operate with the follower to prevent rotational movement of the drive shaft at the engaged position and at the disengaged position and allow rotational movement of the drive shaft at the operative position.

9. The multi-tip tool of claim 8 wherein the follower includes a detent ball.

10. The multi-tip tool of claim 9 wherein the detent ball includes a first detent ball and a second detent ball, the first detent ball being spring-loaded into engagement with the grooves.

11. A multi-tip tool comprising:

a cylinder assembly having a longitudinal axis;

a push button assembly coupled to the cylinder assembly and movable relative to the cylinder assembly in a direction transverse to the longitudinal axis; and a drive shaft coupled to the push button assembly.

12. The multi-tip tool of claim 11 wherein the drive shaft includes a first longitudinal groove and a circumferential groove and the push button assembly includes a follower, the follower being disposed to engage the first longitudinal groove and the circumferential groove.

13. The multi-tip tool of claim 12 wherein the circumferential groove includes two parallel grooves disposed in spaced apart relation and intersecting the longitudinal groove, the two parallel grooves being connected by a crossover groove.

14. The multi-tip tool of claim 13 wherein the drive shaft includes a second longitudinal groove offset from the first longitudinal groove and the crossover groove.

15. The multi-tip tool of claim 14 wherein the push button assembly includes a follower disposed to engage the first longitudinal groove and the second longitudinal groove, the follower moving along the second longitudinal groove between a replacement position to an operative position and along the first longitudinal groove between the operative position and an engaged position.

16. The multi-tip tool of claim 15 wherein the drive shaft moves transversely between the engaged position and a disengaged position.

17. The multi-tip tool of claim 11 wherein the push button assembly includes a receiver, a push button disposed in the receiver, and a spindle coupled to the receiver.

18. The multi-tip tool of claim 17 wherein the spindle extends along the longitudinal axis of the cylinder assembly.

19. The multi-tip tool of claim 17 wherein the spindle includes a longitudinally extending U-shaped channel configured to receive an end of the drive shaft.

20. The multi-tip tool of claim 19 wherein the end of the drive shaft includes a tenon, the push button includes a follower, and the drive shaft includes a longitudinal groove, the follower cooperating with the longitudinal groove to orient the tenon while the drive shaft is disposed in the U-shaped channel.

21. A multi-tip tool comprising:

a cylinder assembly having an operating axis, a central conduit, a plurality of chambers disposed circumferentially around the central conduit, and plurality of passages connecting the plurality of chambers with the central conduit;

a working tip disposed in one of the plurality of chambers and including a working end and an engaging end, the engaging end including a first engagement feature;

a push button assembly coupled to the cylinder assembly; and a drive shaft coupled to the push button assembly and having a distal end with a second engagement feature, the second engagement feature being complementary to be the first engagement feature to couple the drive shaft to the working tip, the drive shaft being movable in a first direction along the operating axis between an engaged position and a replacement position, and in a second direction transverse to the operating axis between the engaged position and a disengaged position.

22. The multi-tip tool of claim 21 wherein the first engagement feature includes a mortice having a generally circular cross section and the second engagement feature includes a complementary tenon, the mortice and tenon being aligned with a longitudinal axis of one of the plurality of passages.

23. A method for engaging one of a plurality of working tips of a multi-tip tool with a drive shaft, the method comprising the steps of:

positioning a working tip on an operating axis;

aligning the drive shaft with the working tip; and moving the drive shaft transversely to the operating axis to engage the working tip.

24. The method of claim 23 wherein the multi-tip tool includes a working tip storage cylinder having a plurality of chambers for receiving the plurality of working tips and a central conduit, the step of aligning the drive shaft includes the step of moving the drive shaft along a longitudinal axis of the central conduit from a standby position to a disengaged position and moving the drive shaft transversely to the longitudinal axis from the disengaged position to an engaged position.

25. The method of claim 24 wherein one of the working tip and drive shaft includes a tenon and the other of the working tip and drive shaft includes a mortice, the tenon and mortice engaging each other as the drive shaft moves transversely.

26. A method for replacing a working tip in a multi-tip tool having an axis and a drive shaft, the method comprising the steps of:

moving the working tip and drive shaft along the axis to a first position;

rotating the tip and drive shaft about the axis at the first position to a second position, the second position being radially offset from the first position;

moving the working tip and drive shaft from the second position along the axis to a replacement position.

27. The method of claim 26 wherein the step of moving the working tip and drive shaft to a replacement position includes the steps of rotating the tip and drive shaft about the axis from the second position to a third position, and moving the working tip and drive shaft along the axis from the third position to the replacement position.

28. A method for disengaging a working tip from a drive shaft, wherein the working tip and drive shaft lie along a tool axis, the method comprising steps of;

moving the working tip and drive shaft along the axis to an engaged position;

moving the drive shaft transversely to the axis from the engaged position to a disengaged position.

29. A method for disengaging a working tip from a drive shaft wherein the working tip and the drive shaft are disposed in a bore having an open end, the method comprising the steps of:

moving the drive shaft longitudinally to a first position in the bore;

rotating the drive shaft from the first position to a second position radially offset from the first position; and rotating the drive shaft from the second position to a third position, the drive shaft being movable longitudinally from the third position to a replacement position.

* * * * *